United States Patent [19]

Zinn

[11] Patent Number: 4,915,654

[45] Date of Patent: Apr. 10, 1990

[54] ELECTRIC PLUG CONNECTOR

[75] Inventor: Bernd Zinn, Ennepetal, Fed. Rep. of Germany

[73] Assignee: Grote & Hartmann GmbH & Co. KG, Fed. Rep. of Germany

[21] Appl. No.: 306,679

[22] Filed: Feb. 6, 1989

[30] Foreign Application Priority Data

Mar. 25, 1988 [DE] Fed. Rep. of Germany ..... 3810209

[51] Int. Cl.[4] ..... H01R 13/436; H01R 13/422

[52] U.S. Cl. ..... 439/595; 439/752

[58] Field of Search ..... 439/595, 733, 752, 744, 439/871, 869

[56] References Cited

U.S. PATENT DOCUMENTS

| | | | |
|---|---|---|---|
| 3,487,355 | 12/1969 | Cairns | 439/733 |
| 3,944,312 | 3/1976 | Koenig | 439/744 |
| 4,323,296 | 4/1982 | Andoh | 439/595 |
| 4,400,049 | 8/1983 | Schuck | 439/733 |
| 4,474,417 | 10/1984 | Millhimes et al. | 439/744 |
| 4,690,477 | 9/1987 | Doutrich et al. | 439/595 |
| 4,705,337 | 11/1987 | Maeda | 439/595 |
| 4,740,177 | 4/1988 | Heimbrock | 439/595 |
| 4,804,347 | 2/1989 | Kato et al. | 439/733 |

FOREIGN PATENT DOCUMENTS

| | | | |
|---|---|---|---|
| 3330151 | 3/1985 | Fed. Rep. of Germany | 439/752 |
| 1491217 | 11/1977 | United Kingdom | 439/733 |

*Primary Examiner*—Gary F. Paumen

*Attorney, Agent, or Firm*—Jones, Askew & Lunsford

[57] ABSTRACT

The invention pertains to an electric plug connector with a contact plug housing and a contact sleeve housing, each of which has two side walls, two end walls, and, paralleling the side walls, a compartment partition with transverse compartment partitions, and with a passageway leading from one end wall and through the longitudinal compartment partition and the transverse compartment partitions, through which a bar-like locking slide can be inserted and withdrawn, while, in the area of each compartment, a prelocking stay is inserted through an open, U-shaped hole in the side walls, the base arm of which is directed toward the opening of the compartment, and the free ends of which protrude into the inner space of the compartment and are provided with an engagement shoulder rounded toward said inner space of the compartment.

7 Claims, 4 Drawing Sheets

FIG.1
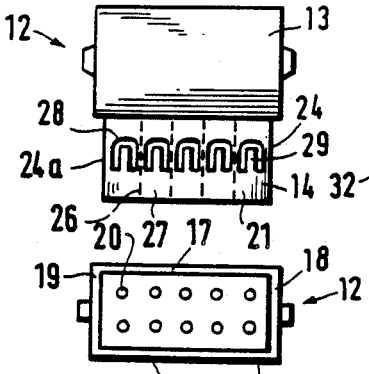
FIG.2
FIG.3
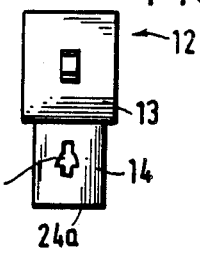
FIG.4
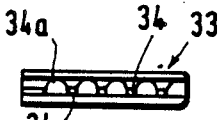
FIG.5
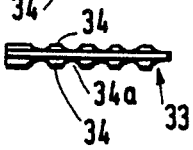
FIG.6
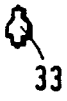
FIG.7
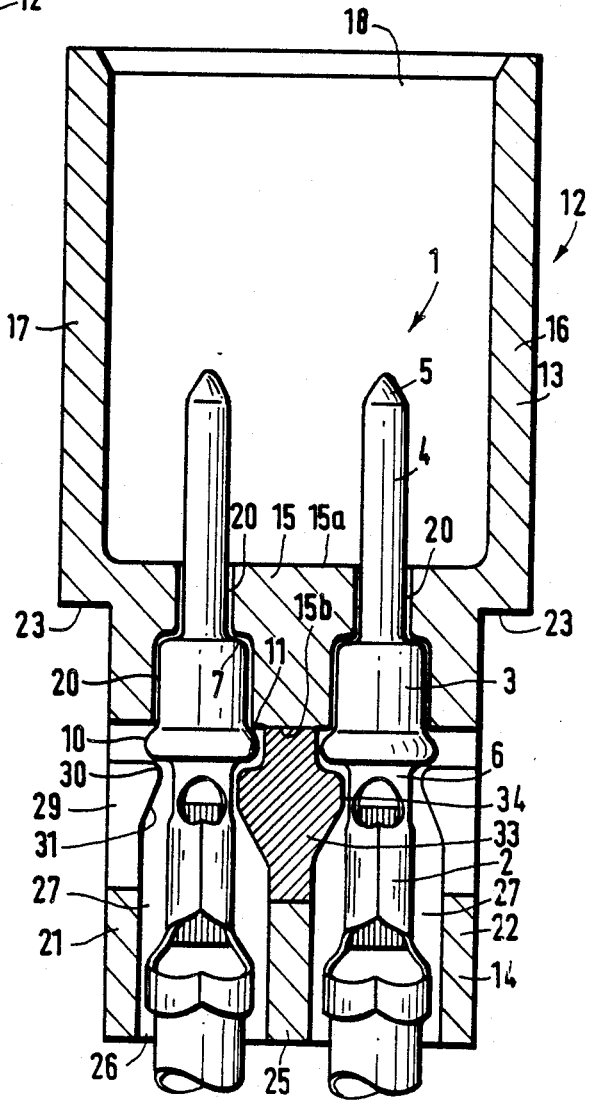

FIG. 8
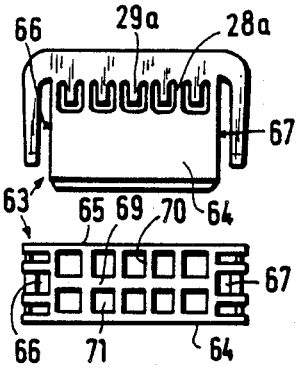
FIG. 9
FIG. 10
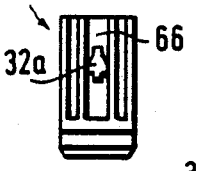
FIG. 11
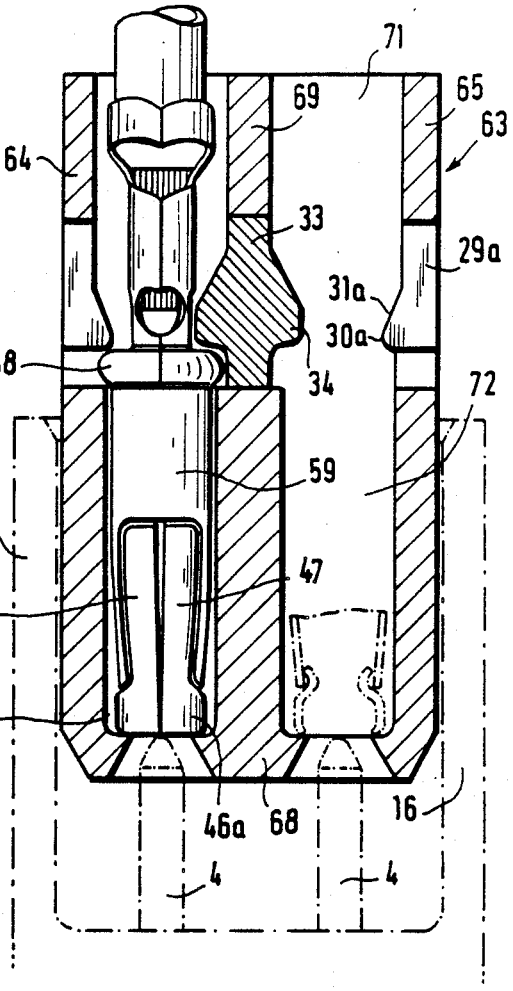
FIG. 12
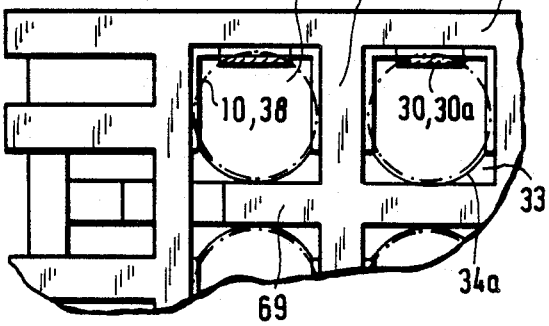
FIG. 13
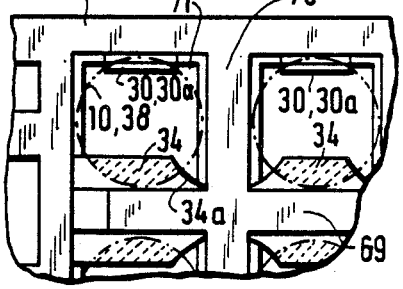

ELECTRIC PLUG CONNECTOR

FIELD OF THE INVENTION

The invention pertains to an electric plug connector with a contact plug housing and a contact sleeve housing.

BACKGROUND OF THE INVENTION

There is a known electric plug connector with locking plug housings, which have two side walls, two end walls, and housing compartments separated by partitions. At least one compartment partition paralleling the side walls, which has matching holes in the longitudinal direction for the insertion of a locking slide, extends from one end wall to the other. The bar-like locking slide can be advanced into matching holes in the end wall of the housing. It has laterally projecting cams, which, in the inserted state, protrude into the inner space of the housing compartment and snap behind an edge or the like of a plug sleeve or a plug prong, so that the plug contact is seated in the compartment of the housing and secured against withdrawal.

Known from German Patent No. 2,731,001 is a round plug sleeve with an override spring, which has two contact-spring arms, against which two override-spring arms press from the outside. The contact-spring arms and the override-spring arms are not symmetrically spaced around the periphery, so that, effectively, only a one-sided contact can be established. This round plug sleeve is not amenable to miniaturization, since the asymmetrical spring action will not guarantee a secure contact. In the case of this known round plug sleeve, the override spring has locking spring arms, which snap behind a locking edge in a plug housing. These locking-spring tongues represent obstacles when used in a locking plug housing, since, at a minimum, they make it difficult to remove the round plug sleeve from the housing after unlocking and, in addition, would tend to destroy, during their withdrawal, a rubber seal placed, e.g., in the insertion aperture of a compartment of the plug housing. Furthermore, it is practically impossible to equip miniaturized round plug sleeves with catch spring tongues.

Additionally, round plug prongs are known with longitudinally sequential sections consisting of a crimp section at the rear end, then a connection section followed by a support section, and a hollow, cylindrical section with a rounded point at the front end. For a miniaturized configuration and for use in a lockable plug housing, the known round plug prongs are not suitable, since the transition zones from the crimp section to the support section and from the support section to the round point section are not sufficiently stable to resist moments of flexion.

The installation and/or replacement, e.g., of such plug contacts already crimped to electric conductors (in the known plug housings), require careful attention and painstaking effort. The plug contacts are loose inside a compartment and have therein no restraints to prevent their removal or falling out; only the cams of the inserted locking slide provide such restraint. The known plug contacts insertable in the housing compartments have, for the most part, a sharp-cornered cutting edge behind which a cam of the locking slide engages. When the plug contact is withdrawn, this sharp edge can destroy the rubber seal. In addition thereto, the known plug contacts have still other sharp projections, which can also damage the rubber seal even during the insertion of the plug element into the compartment of the housing.

The objective of the invention is the creation of a plug connector with plug housings with a locking slide, in which the insertion and/or removal of plug contacts is safer and simpler.

BRIEF DESCRIPTION OF THE DRAWINGS

With references to the appended drawings, the invention is described in greater detail below in terms of embodiment examples. The drawings depict:

FIG. 1, a side view of the plug housing of the plug connector of the invention.

FIG. 2, a bottom view of the plug housing in FIG. 1.

FIG. 3, a front view of the plug housing in FIG. 1.

FIG. 4, a side view of the locking slide for the plug housing in FIGS. 1–3.

FIG. 5, a top view of the locking slide in FIG. 4.

FIG. 6, a front view of the locking slide in FIG. 4.

FIG. 7, a cross section through the plug housing in FIGS. 1–6 with inserted plug prongs.

FIG. 8, a side view of the sleeve housing of the plug connector of the invention.

FIG. 9, a bottom view of the sleeve housing in FIG. 8.

FIG. 10, a front view of the sleeve housing in FIG. 8.

FIG. 11, a cross section through the sleeve housing in FIGS. 8–10 with inserted plug sleeves.

FIG. 12, a top view of a portion of the sleeve housing in FIGS. 8–11 with the locking slide in an unlocked position.

FIG. 13, a top view of a portion of the sleeve housing with the locking slide in its locked position.

DETAILED DESCRIPTION OF THE INVENTION

Figure 14:
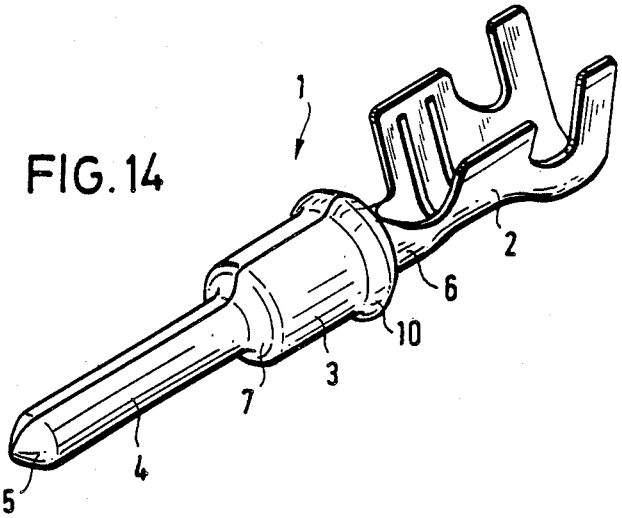
FIG. 14, a perspective view of a plug prong for the housing in FIGS. 1–7.
Figure 15:
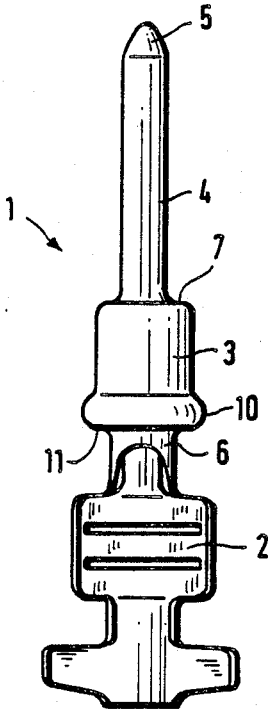
FIG. 15, a top view of the plug prong in FIG. 14.
Figure 16:
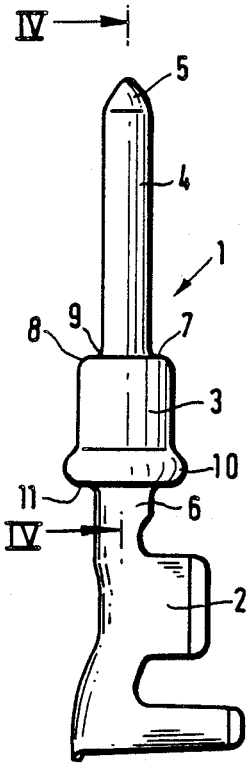
FIG. 16, a side view of the plug prong in FIG. 14.
Figure 17:
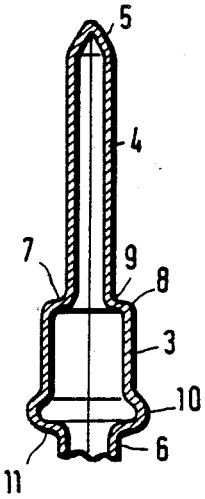
FIG. 17, a longitudinal section through the front contact and base sections of the plug prong along the line IV—IV in FIG. 16, with the viewing direction indicated by the arrow.
Figure 18:
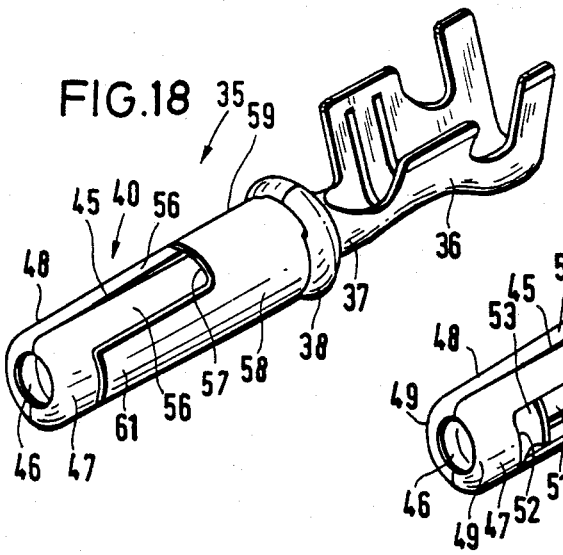
FIG. 18, a perspective view of a plug sleeve for the housing in FIGS. 8–13.
Figure 19:
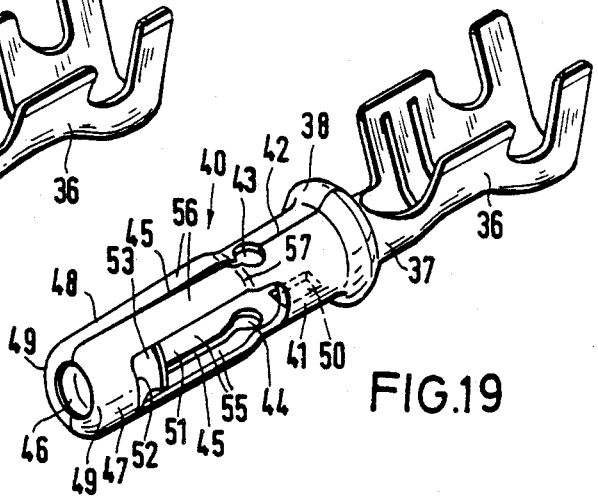
FIG. 19, a perspective view of the plug sleeve without the override spring.

The plug prong (1), which is rolled from a stamped piece of sheet metal and is especially well suited for the miniature design, is, e.g., 16 mm long and has a crimp section (2), a hollow, cylindrical base section (3), and a round, pin-like, hollow, cylindrical plug or contact section (4) with a rounded, conically tapered tip (5). The outside diameter of the contact section (4) in the miniature configuration is, e.g., 1 mm, as can be seen in FIG. 2. Stability vis-a-vis moments of flexion is ensured in a practical fashion by a short cylindrical transition section (6) between the crimp section (2) and the base section (3) and a shoulder (7) between the base section (3) and the plug section (4), the edges (8) and corners (9) of which are rounded off, while the outside diameter of the base section (3) is greater than the outside diameters of the contact section (4) and the transition section (6) and the outside diameter of the transition section (6) is greater than the outside diameter of the contact section (4). This design or stepping of the sections (4, 3, 6) provides a high degree of resistance to moments of flexion.

In a special embodiment form of the invention, the part of the base section (3) bordering on the transition section (6) is designed as a bulged bead (10), which is semicircular in cross section, so that a relatively large undercut or a relatively deep step with pronounced transition is formed for the transition from the bead (10) to the transition section (6), which greatly simplifies the shaping and provides a relatively large annular locking surface (11), while also making possible a cylindrical and pronounced design of the transition section (6) with a relatively great outside diameter.

Several plug prongs (1) can be inserted into the cross sectionally rectangular plug housing (12) of an electric plug connector in keeping with the invention, which connector basically consists of a plug housing and a sleeve housing. The plug housing (12) consists of a prong trough (13) and a compartmentalized housing (14) ordered one over the other. The prong trough (13) has a base plate (15), two parallel side walls (16, 17) and two end walls (18, 19). The base plate (15) has holes (20) oriented perpendicularly to the plane (20*a*) of the base, each of which facilitates the positioning of the contact section (4) of a plug prong (1). The compartment housing (14) situated beneath the prong trough (13) has side walls (21, 22) paralleling and inwardly slightly offset from the side walls (16, 17) of the prong trough (13), so that in each case a stepped rim (23) is formed. The side walls (21, 22) are frontally delimited by the end walls (24, 24*a*). Parallel to the side walls (21, 22) there is a medial, longitudinal partition (25) with several transverse partitions (26) arranged at right angles thereto, so that essentially square compartments (27) for prong contacts are formed. In the area of each compartment (27), a prelocking stay (29), which can swing elastically outward, fits into U-shaped holes (28) in the side walls (21, 22), while the base uniting the two arms of the U is situated slightly above or at the level of the base plane (15*b*) which is provided with a baseside, rounded, protruding engagement shoulder (30) with a guide incline (31) oriented toward the interior of the compartment.

The holes (20) widen in stages toward the compartments (27) and the holes (20*a*) in such a way that the holes (20) can snugly receive the contact sections (4) and the holes (20*a*) [can receive] the base sections (3) of the plug prongs (1).

The base side of the bead (10) on the plug prong (1) can rest directly on the surface (15*b*) of the base or is arranged above the base surface (15*b*) and is overridden by the engagement shoulder (30) on the transition-section side.

From the end wall (24*a*), a passageway (32) leads through the longitudinal partition (25) and the transverse partitions (26), which passageway is traversed by a bar-like, insertable, and removable locking slide (33). The cross-sectional configuration of the slide (33) is matched to that of the passageway (32), while the slide is designed in a known manner with lateral locking cams (34) on both sides, which protrude into the inner space of the compartment, are so arranged as to face the engagement shoulders (30) when the slide is inserted, and have approximately the same cross-sectional configuration as these engagement shoulders. The locking cams (34) also override the bead (10) on the plug prong (1) (FIG. 7).

In keeping with the invention, the plug prongs (1) can be inserted into the compartments (27) whenever the slide (33) is not in the housing or is in a position in which the cams (34) do not protrude into the inner space of the compartments. Since the engagement shoulders (30) of the prelocking stays fit behind the bead (10) on the plug prong (1), a kind of prelocking action takes place, which can, nonetheless, be disengaged when the plug prong (1) is pulled against the spring power of the locking stay (29) with sufficient force. The prelocking stays (29) greatly facilitate the insertion and replacement of plug contacts by securing the inserted contacts.

A round plug sleeve (35) especially well suited for the plug connector of the invention has a crimp section (36), a short, cylindrical transition section (37), an ensuing bead (38) with an annular locking edge (39), and a contact section (40) extending forward and terminating in a conical tip.

The contact section (40) begins at its point of connection to the bead (38) with a cylindrical, spring-tongued base (41), the diameter of which is greater than the diameter of the transition section (37). The contact section (40) has a longitudinal abutment joint (42). At the front end of the spring-tongued base (41), a circular cutout (43) is formed in the vicinity of the abutment joint (42); a second circular cutout (44) is made in the spring tongued base (41) opposite the first cutout. Extending forward from these circular cutouts (43, 44) are wedge-shaped slits (45), which converge toward the end of the contact section (40) or the circular orifice (46), so that two opposing spring arms (47, 48) are formed. The ends (49) of these spring arms (47, 48) are bent inward toward the plug orifice (46) and are punched in such a way that they form said circular plug orifice (46), the diameter of which corresponds with the outside diameter of the contact section (4) of the round plug prong (1).

Opposite the abutment joint (42) and between the cutout (44) and the bead (38), there is a rectangular cutout (50) in the spring-tongue base (41), the purpose of which is explained further below.

In the vicinity of the longitudinal middle of each spring arm (47, 48), there is an approximately rectangular cutout (51), which begins at the approximate level of the cutouts (43, 44) and terminates in an edge (52) shortly before the orifice (46). Joining this edge (52) is a short, incised tab (53), the width of which matches that of the cutout (51) and which extends to the spring-tongue base (41); this tab is recurved on itself toward the inner space of the contact section (40) to form a resistance stay (54) (FIG. 22) which is hook-like in cross section and whose function will be explained further below.

The spring-tongue stays (55, 56) of each spring arm (47, 48) formed in the punching of the cutout (51) are outwardly offset by a material thickness at the point where they join the springtongue base (41), so that an offset rim (57) is formed.

The round plug sleeve (35) is equipped with an override spring (58) with a cylindrical base (59), which fits snugly over the spring-tongue base (41), so that the abutment joint of the base (59) of the override spring aligns opposite the abutment joint (42). In the vicinity of this abutment joint (42) of the base (59) of the override spring, there are peripheral, incised tabs (60) , which curve into and border the edges of the cutouts (50) to ensure that the override spring (58) makes secure contact with the round plug sleeve (35).

The base (59) of the override spring extends from the bead (38) to the offset rim (57). Joined to the base (59) of the override spring are two curved, opposing override-spring arms (61, 62) which extend forward in the cutouts (51) to the juncture edge (52), while their free ends override and press against the matching resistance stays (54). This design of the round plug sleeve (35) makes it possible for the override spring (58) to be kept within the contours of the round plug sleeve. The arms (61, 62) of the override spring essentially fill completely the gaps in the spring arms (47, 48) formed in the punching of the cutouts (51). The depression in the spring-tongue base (41) formed by the offset (57) of the spring arms (47, 48) is filled by the base (59) of the override spring. In this manner, a smooth contact section (40) of the round plug sleeve (35) is formed, which, e.g., can be inserted through matching holes in a rubber seal or removed therefrom without fear that the rubber seal will be destroyed or damaged. The arms (61, 62) of the override spring press against the resistance stays (54) and reinforce the spring action of the spring arms (47, 48).

Figure 22:
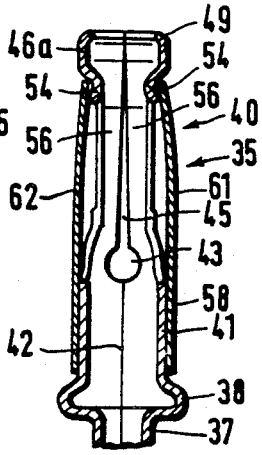
FIG. 22, a longitudinal section through the front contact and base sections of the plug sleeve along line XI—XI in FIG. 21, with the viewing direction indicated by the arrow.

The spring arms (47, 48)—as already noted—taper conically to a point, which results from the conical course of the slits (45). Accordingly, the arms (61, 62) of the override spring also converge, so that the outside diameter of the base (59) of the override spring is greater than the outside diameter of the contact section (46*a*) of the spring arms (47, 48) (FIGS. 20, 22, and 10).

The sleeve housing (63) in keeping with the invention fits in the plug trough (13) of the plug housing (12) to establish the plug contact (FIG. 11). The sleeve housing (63) has longitudinal sidewalls (64, 65), end walls (55, 67), and a base plate (68). A longitudinal compartment partition (69) paralleling the side walls (64, 65) extends medially through the sleeve housing (63) from one end wall (66) to the other end wall (67). Transverse partitions (70) form, together with the side walls (64, 65) and the longitudinal partition (69), compartments (71) for, e.g., round plug sleeves (35). The height of such a compartment (71) is approximately the same as the length of a round plug sleeve, while the contact section (40) lies in a cylindrical portion (72) of the compartment, so that the spring arms (47, 48) have room (73) to spring outward.

In the part of the side walls (64, 65) above the compartment section (72)—as in the case of the plug housing (12)—each compartment (71) has a prelocking stay (29*a*), which can swing elastically outward and which is inserted through a U-shaped hole (28*a*), the base stay of which is situated immediately above the compartment section (72), while its engagement shoulder (30*a*) protruding into the inner space of the compartment is designed with a guide incline (31*a*). A passageway (32*a*) leads from the end wall (66), through the longitudinal partition (69) and the transverse partitions (70), and into a depression (32*a*) in the other end wall (67); a bar-like locking slide (33) can be inserted into and withdrawn from this passageway. The crosssectional configuration of the slide (33) is matched to that of the depression (32*a*) and has lateral locking cams (34) of known design on both sides of the part of the slide protruding into the inner space of the compartment, which cams have approximately the same cross-sectional configuration as the engagement shoulder (30*a*) and align opposite such shoulder when the slide is fully inserted. The locking cams (34) override both the engagement shoulder (30*a*) and the bead (38) on the round plug housing (35) (FIG. 10). The function of the locking slide (33) and the prelocking stays (29*a*) is the same as that of the comparable parts in the plug housing (12).

Figure 20:
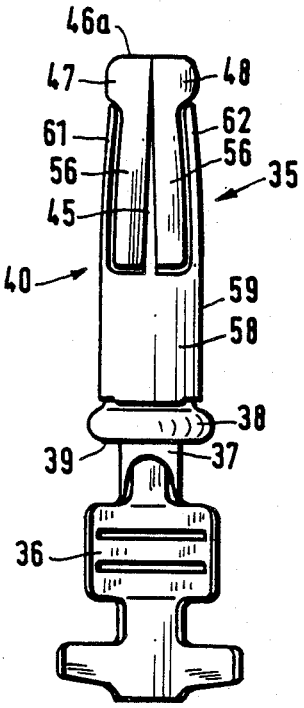
FIG. 20, a top view of the plug sleeve in FIG. 18.
Figure 21:
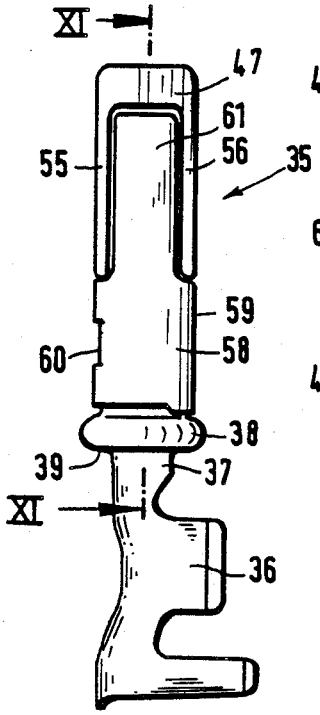
FIG. 21, a side view of the plug sleeve in FIG. 18.

FIGS. 20 and 21 depict a different configuration of the locking slide (33). Between the cams (34), this locking slide has curved depressions (34*a*) whose radius of curvature matches that of the bead (10, 38). When the locking slide (33) is in the position illustrated in FIG. 20, the depressions (34*a*) are in the area of the compartments (71). Then, only the engagement shoulders (30, 30*a*) extend into the inner space of the chambers. After the insertion of a plug contact (1, 35) into a compartment (71), the engagement shoulder (30, 30*a*) locks behind the bead (10, 38) of the plug contact, so that it can no longer fall out of the compartment. When the required plug contacts have been inserted into the compartments, the locking slide (33) is seated in the housing, so that the locking cams (34) are properly positioned in the individual compartments. In this manner, the plug contacts are locked in place. This locked position is illustrated in FIG. 13.

The housings (12, 63) of the invention can, of course, be used for other plug contacts with a protruding, beaded element functioning in the same manner.

I claim:

1. Electric plug connector having a contact plug housing and a contact sleeve housing, each said housing having the following: two side walls, two end walls and, paralleling the side walls, a longitudinal partition with transverse compartment partitions; a plurality of compartments each holding a contact; a passageway extending from one said end wall and through the longitudinal partition and the transverse partitions to the other said end wall; and a bar-like locking slide adapted to be inserted and withdrawn through said passageway; each said housing being further characterized by the fact that in the side wall of each compartment a prelocking stay, which can swing elastically outwardly and whose free end is directed toward the inner space of the compartment, is provided with a rounded engagement shoulder protruding into said inner space of the compartment, the locking slide and the prelocking stays engagement the contacts to prevent removal thereof from the compartments.

2. Plug connector according to claim 1, characterized by the fact that the engagement shoulders (30, 30*a*) are provided with guide inclines (31, 31*a*).

3. Plug connector according to claim 1, characterized by the fact that the engagement shoulders (30, 30*a*) are positioned in the compartments (27, 71) opposite locking cams (34) of the locking slide (33).

4. Plug connector according to claim 3, characterized by the fact that the locking cams (34) are also provided with guide inclines.

5. Plug connector according to claim 1, characterized by the fact that the engagement shoulders (30 30*a*) are so positioned within the housing (12, 63) that they lock behind a cross-sectionally curved bead (10, 38) on said contacts (1, 35) seated in said compartments (27, 71).

6. Plug connector according to claim 3, characterized by the fact that the locking slide (33) has a cross sectional form matched to that of the passageway (32) and has lateral locking cams (34) protruding into the inner space of the compartments on both sides of the locking slide, which cams have approximately the same cross-sectional form as the engagement shoulders (30, 30*a*) and, in the fully inserted state of the locking slide (33), align opposite said engagement shoulders.

7. Plug connector according to claim 5, characterized by the fact that the locking slide (33) has curved depressions (34*a*) between the cams (34), whose radius of curvature matches the radius of curvature of the bead (10, 38).

* * * * *